United States Patent [19]

Vogt

[11] 4,136,727

[45] Jan. 30, 1979

[54] OPTICAL LENS BLOCKING METHOD AND APPARATUS

[76] Inventor: Albert B. Vogt, 506 Fifth St. South, Sauk Rapids, Minn. 56379

[21] Appl. No.: 814,028

[22] Filed: Jul. 8, 1977

[51] Int. Cl.[2] ..... B22D 17/24; B29D 11/00

[52] U.S. Cl. ..... 164/112; 164/332; 425/808

[58] Field of Search ..... 164/112, 150, 334, 113, 164/332; 425/808; 51/277

[56] References Cited

U.S. PATENT DOCUMENTS

| | | | |
|---|---|---|---|
| 3,152,427 | 10/1964 | Prunier | 51/277 |
| 3,383,808 | 5/1968 | Deshayes et al. | 164/112 X |
| 3,866,667 | 2/1975 | Knight | 164/334 |

*Primary Examiner*—Richard B. Lazarus
*Assistant Examiner*—John S. Brown
*Attorney, Agent, or Firm*—Merchant, Gould, Smith, Edell, Welter & Schmidt

[57] ABSTRACT

An apparatus and method of mounting a lens block on an optical lens blank having predetermined optical and mechanical centers so that the lens block is centered on the blank with respect to the optical center and is provided with recesses aligned on a line through the mechanical center of the lens blank. The apparatus includes a lens blank holder, an optical center alignment device and a lens block forming apparatus having recess-forming projections. The lens blank is placed on the holder and the optical center aligned on the alignment device. The holder is then placed on the lens block forming apparatus such that the recess will be formed along a line through the mechanical center of the blank. Liquid lens block material is then introduced into the forming apparatus and allowed to harden.

20 Claims, 6 Drawing Figures

FIG. 1
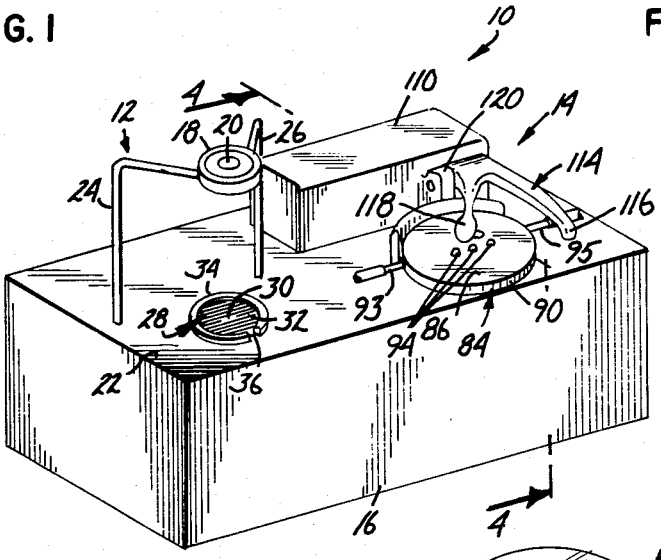
FIG. 2
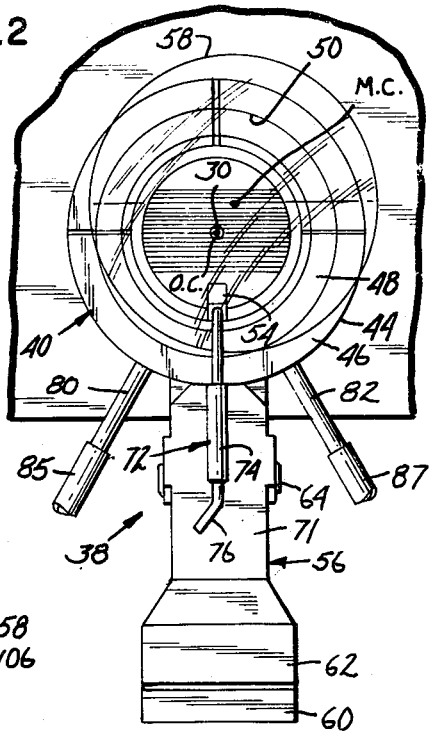
FIG. 3
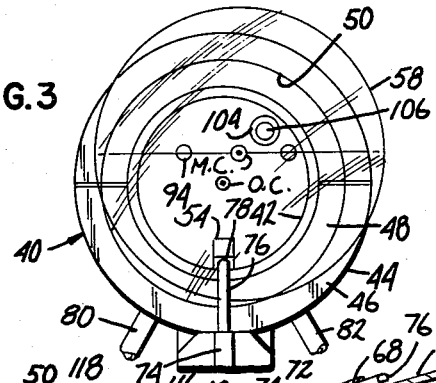
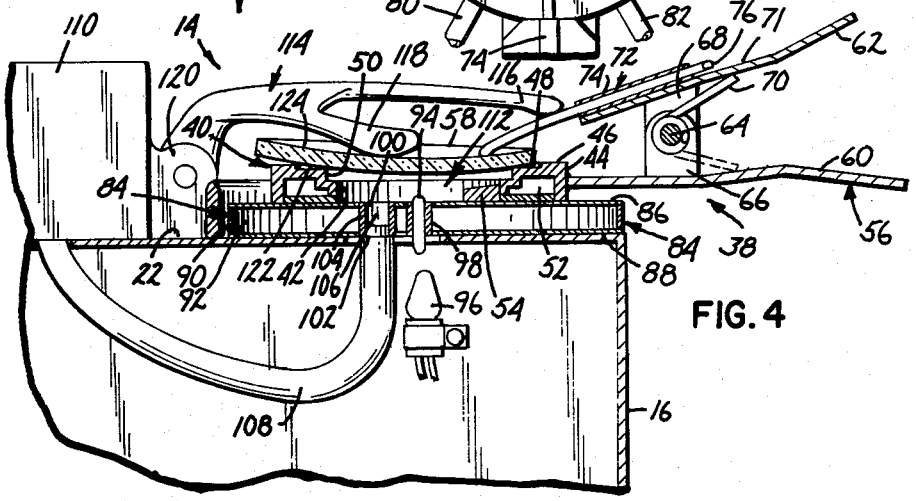
FIG. 4
FIG. 5
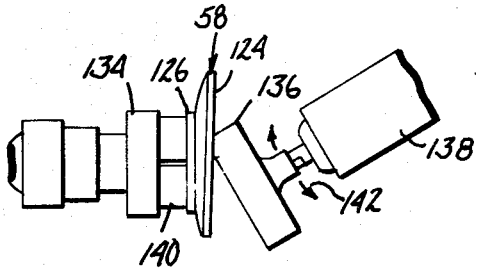
FIG. 6
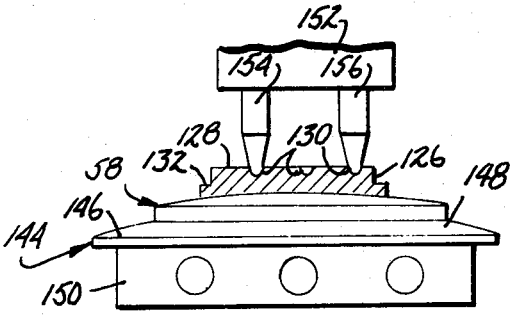

OPTICAL LENS BLOCKING METHOD AND APPARATUS

BACKGROUND OF THE INVENTION

The present invention relates broadly to a method and apparatus for mounting a lens block to an optical lens blank so that the lens blank can be processed in apparatus for generating and polishing the optical lens surfaces. In particular, the present invention relates to a method and apparatus for mounting a block to a lens blank with the block centered with respect to the optical axis of the finished lens and with recesses in the lens block aligned along a line drawn through the mechanical center of the lens blank.

In the manufacture of ophthalmic lenses, a lens blank is formed into a finished lens by grinding and polishing the lens surface to a desired curvature in accordance with the prescriptive needs of the patient. Typically, lens blanks are provided having one surface ground and finished to a spherical curvature. This surface is generally on the convex side of the lens blank. The lens blank is finished by grinding and polishing the concave side of the lens to the appropriate curvature. As a rule, the concave surface will be generated as a toric surface having different curvatures at right angles to each other. Occasionally, the concave surface will be generated as spherical. To ensure that the lens blank is oriented properly for the subsequent generation of the toric surface, it is desirable to center the lens block with respect to the ultimate optical center of the finished lens. The lens blank is mounted in the surface generation machinery by the lens block, and in the conventional prior art devices, the concave surface of the lens blank is swept by a rotating grinding wheel. Once the toric surface is generated, the lens blank is then ground and polished with standard lapping equipment utilizing abrasion tools that correspond with the toric surface generated by the grinding wheel.

A number of blocking methods and apparatus have been proposed in the prior art. In perhaps the most popular method, a metal block is secured to the finished or convex side of the lens blank with a suitable adhesive material. The block has holes aligned along a line through the optical center of the finished lens. The adhesive material may be pitch or a low melting point alloy. In the methods that utilize pitch or an equivalent adhesive the metal blocks and finished lens must be thoroughly cleaned upon completion of each surfacing operation. The cleaning of the lens block is a time-consuming and therefore costly step in the manufacture of the ophthalmic lenses. The low melting point alloy is somewhat cleaner in that the melting point is such that the alloy will melt in relatively low temperature water and be completely removed from the lens block and lens blank with minimal effort.

The prior art methods and apparatus that utilize a permanent metal lens block having mounting recesses referenced to the optical center of the finished lens have been found to be unacceptable when utilized for mounting relatively large lens blanks in the lapping and polishing apparatus. The problem has become more critical with the increasing popularity of large spectacle frames consequently requiring large ophthalmic lenses. In the lapping and polishing apparatus, the toric surface is placed on a lapping or polishing tool. The lens blank is pressed against the polishing tool and moved over the tool while a slurry of abrasive or polishing compound is introduced onto the tool. When large lens blanks are utilized and the conventional metal lens blocks are affixed to the lens blanks with respect to the optical center, pressure is applied unevenly across the large area lens blank. This results from the fact that the mechanical or geometric center of the large lens blank is typically spaced from the ultimate optical center. The lapping and polishing tool is provided with projecting members that are received with the recesses formed on the metal block along a line through the optical center. This uneven application of pressure with respect to the mechanical center of the lens blank results in uneven grinding of the toric surface. Since the toric surface is not uniformly polished unwanted prism is introduced into the lens. This unwanted prism adversely affects the optical properties of the ophthalmic lens. It is therefore desirable to apply pressure evenly to the lens blank as it is being lapped and polished.

The U.S. patent to Rudd et al 3,226,887 discloses a method and apparatus for processing of ophthalmic lenses in which a lens block is provided that allows the toric surface to be generated with respect to the optical center of the lens while at the same time permits the grinding and polishing of the toric surface about the ultimate mechanical center of finished lens. The lens block of the Rudd patent includes two separate fixtures referred to as a mechanical center ring and an optical center ring. The rings are presumably formed of a suitable metal and are adhered to the lens blank utilizing a suitable bonding material such as a low melting alloy. The mechanical ring has sockets which may be aligned with respect to a horizontal line drawn across the blank through the ultimate mechanical center of the finished lens. The mechanical center of the finished lens may differ from the mechanical center of the lens blank. Thus, to insure even pressure distribution over the lens blank during grinding and polishing, the blank edges should be ground prior to the polishing step to remove any uneven overhang. This procedure necessitates the additional time-consuming step of edge grinding prior to lapping and polishing of the lens. Also, the removal of the uneven overhang of the blank to insure balanced pressure applied to the lens blank during the lapping and polishing step could result in the polished lens blank being too small to fit in the large lens frames that are becomingly increasingly popular. The lapping and grinding tool has pins which are received within the socket such that pressure is applied to the lens blank during the lapping and polishing operation.

While dealing with the problem of uneven grinding during the lapping and of a finished lens, the Rudd method utilizes a lens block having permanent metal rings that must be subjected to the same cleaning steps after use as the prior art metal blocks. Additionally, the steps of aligning the rings with the ultimate optical and mechanical centers of the finished lens are somewhat complex and time-comsuming. As previously mentioned the Rudd method and apparatus is not particularly applicable in processing large lens blanks to fit large spectacle frames.

The present invention eliminates the disadvantages of the prior art blocking methods and apparatus in that it is a method and apparatus for applying a lens block formed entirely of a low melting point material which is applied to the lens blank and hardens to form a block centered with respect to the optical center of the finished lens and which is provided with recesses oriented along a line drawn through the mechanical center of the lens blank. The lens block formed by the method and apparatus of the present invention is thus relatively inexpensive with respect to the prior art blocks and is characterized by the ease of application and alignment of the lens block and depressions therein with respect to the optical center and mechanical center, respectively. The lens block is removed by simply heating the block such that the block material returns to a molten or liquid state.

SUMMARY OF THE INVENTION

The present invention is a method and apparatus for mounting a lens block on an optical lens blank and includes a lens blank holder to which the lens blank is secured so that the optical center of the lens blank is aligned with respect to the central axis of the formed lens block. A plate member having a substantially planar surface is provided and has a plurality of projecting members extending outwardly therefrom. The lens blank holder is placed on the plate with a line drawn through the mechanical center of the lens blank aligned with the projecting members. The plate member, the lens blank holder, and the lens blank define an enclosed chamber into which lens block material in a liquid state is introduced. The projecting members define recesses in the hardened lens block along the line through the mechanical center of the lens blank.

In the preferred embodiment, the leens blank holder includes a hollow annular member having inside and outside diameters, the inside diameter defining the exterior dimension of the lens block. Means including a clamp is affixed to the lens blank holder for securing the lens blank to the annular member. The plate member has a first end portion with a substantially planar surface on which the projecting members are fixed, a second end portion, and a continuous side wall connecting the first and second end portions. The end portions and the continuous side wall define an enclosed chamber. Means are provided for circulating cold water through the hollow annular member and the enclosed chamber to cool the liquid lens block material.

The apparatus of the present invention also includes a means for aligning the lens blank on the holder such that the central axis of the hardened lens block will be aligned with the optical axis of the lens blank. The alignment means includes a retaining ring about which the annular member is placed. The retaining ring has an outside diameter substantially equal to the inside diameter of the annular member. A grid is affixed within the retaining ring, the grid being marked at the center to indicate the center of the retaining ring and thereby indicate the center of the finished lens block.

The method of the present invention includes a step of aligning the lens blank on a lens blank holder so that the optical axis of the lens blank is aligned with the central axis of the finished lens block. The lens blank holder is placed on a plate member having at least two projecting members and aligned so that a line drawn through the mechanical center of the lens blank passes through the projecting members. The lens blank holder, plate member, and lens blank define an enclosed chamber. Lens block material in a liquefied state is introduced into the enclosed chamber and then allowed to harden to form the lens block having depressions therein defined by the projecting members along the line through the mechanical center of the lens blank.

From the above description it will be apparent that the present invention provides a method and apparatus for quickly and economically mounting a lens block to a lens blank with the block oriented with respect to the optical center of the utlimate finished lens and with recesses in the lens block oriented along a line drawn through the mechanical center of the lens blank. While specific structure is disclosed, it is to be understood that alternative structures that are the functional equivalents of the disclosed structure are contemplated within the spirit and scope of the present invention. The advantages of the present invention will become apparent with reference to the following drawings, detailed description of the preferred embodiment, and claims.

BRIEF DESCRIPTION OF THE DRAWINGS

FIG. 1 is a view in perspective of the lens blank block incorporating the present invention;

FIG. 2 is an enlarged fragmentary plan view of a portion of FIG. 1 with the lens blank holder in position on the optical center alignment device of the present invention;

FIG. 3 is an enlarged fragmentary plan view of a portion of FIG. 1 with the lens blank holder in position on the lens block forming apparatus of the present invention;

FIG. 4 is a sectional view taken generally along the line 4—4 of FIG. 1 with the lens blank holder in position on the lens block forming apparatus;

FIG. 5 is a diagrammatic representation of the step of grinding a toric surface on a lens blank blocked in accordance with the present invention;

FIG. 6 is a diagrammatic representation of the step of polishing the generated toric surface with the lens block formed in accordance with the present invention shown in section.

DETAILED DESCRIPTION OF THE PREFERRED EMBODIMENT

Referring to the drawing, wherein like numerals represent like parts throughout the several views, a lens blank blocker incorporating the present invention is designated generally as 10. Blocker 10 includes an optical axis alignment device 12 and lens block forming apparatus 14 mounted on a housing 16. Alignment device 12 includes an eye piece 18 having a magnification lens 20. Eye piece 18 is attached to and spaced apart from a top surface 22 of housing 16 by a pair of support legs 24 and 26. Affixed to top surface 22 is an alignment grid 28 having a center marked at 30 and a plurality of horizontal grid lines as indicated at 32. In the preferred embodiment grid 28 is formed of a translucent material and a light source (not shown) is disposed within housing 16 to provide illumination that will be transmitted through grid 28 to facilitate the alignment of the lens blank on a lens blank holder 38 as will be described in more detail hereafter. Disposed about grid 28 is a retaining ring 34 having a cut-out portion at 36. Center 30 of grid 28 is aligned with the optical axis of magnification lens 20.

The present invention also includes a lens blank holder 38 which is shown in more detail in FIGS. 2–4. Lens blank holder 38 includes an annular member 40 having an inner wall 42, an outer wall 44, and a top surface 46 symmetrically disposed about a central axis. Annular member 40 has a stepped portion 48 proximate top surface 46 which defines an inner wall 50 having a diameter slightly greater than the inside diameter of wall 42. Annular member 40 is hollow having an annular chamber 52 formed therein. A projecting key member 54 is affixed to wall 42 and extends radially inward with respect to the central axis of annular member 40.

Also affixed to annular member 40 is a clamp 56 for securing a lens blank 58 against top surface 46 of annular member 40. Clamp 56 includes a first arm 60 and a second arm 62. First arm 60 is rigidly affixed to outer wall 44 of annular member 40, while first and second arms 60 and 62 are pivotally attached to each other about a shaft 64. Shaft 64 is received within apertures in a pair of bracket members 66 affixed to first arm 60 and a pair of bracket members 68 affixed to second arm 62. A spring 70 which is wound about shaft 64 engages first and second arms 60 and 62 biasing second arm 62 in a counterclockwise direction of rotation as shown in FIG. 4 about shaft 64. Second arm 62 has a top surface 70 to which is affixed a lens blank engaging member 72. Engaging member 72 includes a tubular member 74 in which is received in sliding engagement an adjustable projecting rod member 76. Rod member 76 has an end portion 78 that engages lens blank 58 to hold lens blank 58 against top surface 46 of annular member 40.

An inlet conduit 80 and an outlet conduit 82 are provided for circulating cold water through annular chamber 52 of member 40. Flexible hoses 85 and 87 may be connected to conduits 80 and 82 and to a cold water source (not shown). The purpose of the cold water flow in annular member 40 will be described in more detail hereafter.

Lens block forming apparatus 14 includes a plate member 84 having a substantially planar top surface 86 and a substantially planar bottom surface 88. Top and bottom surfaces 86 and 88 are spaced apart and connected by a side wall 90. Surfaces 86 and 88 along with side wall 90 define an enclosed chamber 92 within plate member 84. Surface 86 has a plurality of projecting members 94 extending outwardly therefrom. At least two projecting members 94 are contemplated in the preferred embodiment of the present invention. Projecting members 94 are aligned along a straight line. In the preferred embodiment, projecting members 94 are translucent or transparent pods which extend beyond bottom surface 88 as well as top surface 86. Disposed beneath bottom surface 88 is an illumination source 96 connected to a suitable source of electrical power (not shown). Projecting members 94 will transmit the light from illumination source 96 to facilitate the alignment of lens blank 58 as will be described in more detail hereafter. Projecting members 94 may be received within sleeves 98 which isolate projecting member 94 from enclosed chamber 92 and seal enclosed chamber 92 at the locations in top surfaces 86 and 88 through which projecting members 94 extend. Apertures 100 and 102 are provided in top and bottom surfaces 86 and 88, respectively. A tubular sleeve insert defines a passageway 106 between apertures 100 and 102. Passageway 106 is sealed from enclosed chamber 92 in plate member 84. A lens block material feed line 108 is connected between aperture 102 and a source of liquefied lens block material 110. As shown particularly in FIG. 4 when annular member 40 is placed on plate member 84, top surface 86, inner walls 42 and 50 of annular member 40, and lens blank 58 define a chamber 112 into which the lens block material in a liquefied state is introduced through aperture 100. Source 110 may provided liquefied block material through line 108 in a number of conventional ways. For example, source 110 may be provided with a manual pump, or may simply be a reservoir for the gravity feed of block material. Alternatively, pressurized air could be utilized to force block material through line 108 and into chamber 112. Communicating with enclosed chamber 92 are a pair of conduits 93 and 95. Cold water from a source (not shown) is circulated through chamber 92 via conduits 93 and 95.

Lens block forming apparatus 14 is also provided with a clamping member 114 having a handle portion 116 and a lens block engagement arm 118. As illustrated in FIG. 4, clamping member 114 is utilized to secure annular member 40 to plate member 84. Clamping member 114 is pivotally mounted in a bracket 120 affixed to housing 16.

The method of forming a block to an optical lens blank in accordance with the present invention will now be described. Typically, a lens blank 58 will be selected that has an optically finished spherical surface 122 and a semi-finished surface 124. In most applications, finished surface 122 is convex and has a predetermined base curvature. Semi-finished surface 124 must be ground to the desired curvature in accordance with the optical requirements of the lens. A lens block 126 for supporting lens blank 58 during the grinding and polishing operations, as illustrated in FIG. 5 and FIG. 6, will preferably be adhered to finished surface 122. After a lens blank having optical characteristics within the desired range is selected, the ultimate optical center of the finished lens is then determined by conventional techniques and marked on the lens blank. The optical center of the lens will be the point at which the lens has zero prism. Additionally, the mechanical center of the lens blank is determined utilizing any convenient prior art method and the mechanical center of the lens blank is marked. A horizontal mechanical center axis is then marked on the lens blank through the mechanical center. Referring to the drawings, the optical center is indicated as O.C. while the mechanical center is indicated as M.C. In the embodiment shown in the drawings, a plurality of closely spaced dots are placed on lens blank 58 to indicate a cylinder axis line through the Optical Center and a horizontal axis line through the Mechanical Center. Alternatively, a single dot can be utilized to indicate the O.C., with the line through the optical center being eliminated.

Lens blank 58 must be aligned on annular member 40 such that O.C. coincides with the center of lens blank 126. Generally, a toric surface is generated by grinding semi-finished surface of 124. A toric surface has different curvatures at right angles to each other and is therefore non-spherical. Thus, during the grinding operation, lens blank 58 must be oriented with respect to the desired O.C. such that the toric surface is properly generated. For this reason, lens block 126 is centered with respect to O.C. so that a chuck engaging lens block 126 holds the lens blank 58 in the proper orientation for toric surface generation.

The center of lens block 126 is the geometric center or central axis of annular member 40. To position O.C. at the geometric center of annular member 40, annular member 40 is placed about retaining ring 34 of optical axis alignment device 12. Retaining ring 34 has an outside diameter slightly smaller than the inside diameter of annular member 40 at surface 42 such that annular member 40 is firmly engaged with retaining ring 34 with radial projecting key member 54 placed within cut-out portion 36. Grid 28 has a center mark 30 and a plurality of horizontal grid lines 32 as shown in FIG. 2. Lens blank 58 is then placed on annular member 40 with optically finished surface 122 engaging top surface 46. Lens blank 58 is oriented such that O.C. is aligned with center mark 30 on grid 28. End portion 78 of rod member 76 is then brought into engagement with surface 124 securing lens blank 58 against surface 46 under the biasing force of spring 70. The optical axis alignment procedure is illustrated by FIG. 2. When working with tinted lenses it may be necessary to energize the light source beneath grid 28. The illumination transmitted through grid 28 highlights center 30 and grid lines 32 facilitating the proper alignment of blank 58.

Once the O.C. has been properly aligned with respect to the eventual center of the lens block 126, annular member 40 is removed from optical axis alignment device 12 and placed on plate member 84 of lens block forming apparatus 14. Annular member 40 is oriented on plate member 84 such that the line passing through M.C. marked on lens blank 58 passes through projecting members 94 and aperture 100 is within annular member 40. This alignment procedure is illustrated in particular in FIG. 3. When annular member 40 has been oriented to align projecting members 94 with the line through M.C. clamping member 114 is positioned such that engagement arm 118 contacts semi-finished surface 124 of lens blank 58 securing annular member 40 in the proper orientation on plate number 84. As previously mentioned when dealing with tinted lens blanks it may be necessary to energize illumination source 96 thereby illuminating projecting members 94.

Liquefied block material is then fed from source 110 through line 108 and into chamber 112. The lens block material is selected to have a melting point substantially lower than the melting point of lens blank 58. Lens block material is also selected such that when the material hardens it will adhere to the material of which lens blank 58 is made. The liquefied lens block material fed into chamber 112 will have been previously heated above the material melting point. When chamber 112 is filled with block material, cold water is directed through annular chamber 52 of annular member 40 and enclosed chamber 92 of plate member 84. The cold water circulating through chambers 52 and 92 serves to cool the liquefied lens block material. When the material cools below the melting point, the material hardens forming a lens block 126 adhered to semi-finished surface 124. Any convenient prior art lens block material may be utilized. One such material is a low melting lead alloy commonly called "low lead". This lead alloy has a melting point of 117 degrees F. Hardened lens block 126 has a substantially planar top surface 128 in which is provided a plurality of depressions 130 formed by projecting members 94, as shown in more detail in FIG. 6. Recesses 130 are aligned along the mechanical axis line through the M.C. of lens blank 58. Stepped portion 48 of annular member 40 provides an annular engagement surface 32 in hardened lens block 126.

After lens block 126 has hardened, lens blank 58 is now mounted for a generation of the toric surface on semi-finished surface 124. The step of generating the toric surface is illustrated in FIG. 5. Any conventional prior art chuck 134 may be utilized to grasp lens block 126 such that lens blank 58 is securely held while grinding wheel 136 grinds the toric surface in surface 124. Grinding wheel 136 may be connected to a suitable driving motor 138. Chuck 134 includes a portion 140 which engages lens block 126 at surface 132. Driving motor 138 is pivoted about an axis normal to the rotational axis of grinding wheel 136 as shown by the double headed arrows at 142. Additionally, driving motor 138 may be rotated in a plurality of directions to generate the desired surfaces of curvature on surface 124. While one particular conventional grinding apparatus is shown in FIG. 5, it will be understood that the blocked lens blank of the present invention could be used with any such conventional prior art device.

FIG. 6 illustrates the final grinding and polishing of surface 124 after surface 124 has been ground to the desired toric surface. FIG. 6 like FIG. 5 also illustrates a conventional prior art grinding an polishing tool, it being understood that any such conventional polishing tool could be utilized with a lens blank blocked in accordance with the present invention. A grinding and polishing tool 144 includes a polishing member 146 having a polishing surface 148 which is a complementary convex toric surface to the concave toric surface generated on lens blank 58. Polishing member 146 is mounted on a base 150 which may be connected to a suitable drive means (not shown) or which may be held stationary. A pressure tool 152 having a pair of projecting members 154 and 156 is also connected to a drive means (not shown) which selectively brings pressure tool 152 into engagement with lens block 126 applying downward pressure on lens blank 58 against polishing member 146 having a polishing surface 148. Drive means may also be designed such that pressure tool 152 is moved in an irregular manner and consequently lens blank 58 is moved over grinding surface 148 in a similar irregular manner to avoid the introduction of any imperfections in the toric surface by repeated contact between the same areas on the grinding surface 148 and surface 124. A slurry of abrasive polishing compound may be introduced onto surface 148 and between surface 148 and surface 124 in any conventional manner. As shown in FIG. 6 projecting members 154 and 156 engage lens block 126 within a pair of recesses 130. As previously mentioned, recesses 130 are aligned along a line through the M.C. of lens blank 58. Thus the downward pressure applied by tool 152 is evenly applied over lens blank 58 so that the toric surface generated on surface 124 is evenly polished. Therefore, the problem in the prior art, particularly when dealing with large lens blanks, of uneven polishing thereby generating unwanted prism within the finished optical lens is eliminated by the lens block of the present invention. When the polishing step is completed, the lens block and blank may be placed in water, heated above the melting point of the lens block alloy material but below the melting point of the lens blank material. The lens block material returns to the liquefied or molten state where it may be removed from the finished lens blank and reclaimed for subsequent use.

From the above description, it is apparent that the present invention discloses a method and apparatus for blocking a lens blank in which the central axis of the block is aligned with the eventual optical center of the finished lens while recesses are provided in the lens block along a line drawn through the mechanical center of the lens blank such that a toric surface may be generated on the lens blank with respect to the optical center while the lens blank may be polished with respect to its mechanical center. As previously mentioned, the lens blank blocked in accordance with the present invention is ground and polished in conventional prior art apparatus. Additionally, while specific structures of optical axis alignment device 12, lens block forming apparatus 14, and lens blank holder 38 are disclosed, it will be understood that alternative equivalent structures which perform the same function as those disclosed in the present application are contemplated within the spirit and scope of the present invention.

I claim:

1. Apparatus for mounting a lens block to an optical lens blank having predetermined independent optical and mechanical centers, the lens block formed of a material which is applied to the lens blank as a liquid and which hardens to form the block, the hardened block having a central axis, comprising:

(a) a base;

(b) a lens blank holder removably mounted to said base and having a central axis corresponding to the central axis of the formed lens block whereby the lens blank can be mounted on said holder with the optical axis thereof aligned with said central axis;

(c) a plate member affixed to said base and having a substantially planar surface on which said holder can be removably placed; said plate member, said holder, and the lens blank defining an enclosed chamber into which the lens block material in a liquid state is introduced;

(d) means on said plate member for forming on the lens block means for holding the lens block in subsequent grinding of the lens blank, said forming means spaced apart and aligned on said plate member whereby said holder can be placed on said plate member with a line drawn through the mechanical center of the lens blank aligned with said forming means;

(e) whereby the blocked lens blank has its optical center aligned with the central axis of the lens block and its mechanical center on a line drawn through said holding means on the hardened lens block.

2. Apparatus in accordance with claim 1 wherein said lens blank holder comprises:

(a) an annular member having inner and outer walls, said inner wall defining the exterior dimension of said lens block; and (b) means including a clamp for securing said lens blank to said annular member.

3. Apparatus in accordance with claim 2 wherein said annular member is hollow and further comprises means for circulating cold water through said hollow annular member to cool said lens block material in the liquid state.

4. Apparatus in accordance with claim 3 wherein said circulating means comprises inlet and outlet conduits in fluid communication with the hollow interior of said annular member.

5. Apparatus in accordance with claim 1 wherein said forming means comprises a plurality of projecting members affixed to said planar surface and extending outwardly therefrom, said projecting members spaced apart and aligned on said plate member.

6. Apparatus for mounting a lens block to an optical lens blank having predetermined optical and mechanical centers, the lens block formed of a material which is applied to the lens blank as a liquid and which hardens to form the block, the hardened block having a central axis, comprising:

(a) a base;

(b) a lens blank holder removably mounted to said base and to which the lens blank is secured such that the optical center of the lens blank is aligned with the central axis of the lens block; and (c) a plate member affixed to said base and on which said holder can be removably placed, said plate member comprising:

(i) a first end portion having a substantially planar surface on which said holder can be removably placed such that said first end portion, said holder and lens blank define an enclosed chamber into which the lens block material in a liquid state is introduced;

(ii) a second end portion;

(iii) a continuous side wall interconnecting said first and said second end portions, said first and second end portions and said wall defining an enclosed chamber into which cold water is introduced to cool the liquid block material;

(d) a plurality of projecting members affixed to said planar surface of said first end portion and extending outwardly therefrom whereby said holder can be placed on said planar surface with a line drawn through the mechanical center of the lens blank aligned with the projecting members; said projecting members defining recesses in the hardened lens block along said line through the mechanical center of the lens blank whereas the optical center of the lens blank is aligned with the central axis of the lens block.

7. Apparatus in accordance with claim 6 wherein said first and second end portions have apertures therein and further comprising means defining a passageway between said apertures for introducing said liquid block material into said enclosed chamber.

8. Apparatus for mounting a lens block to an optical lens blank having predetermined spaced optical and mechanical centers, the lens block formed of material which is applied to the lens blank as a fluid and hardens to form the lens block, the formed lens block having a central axis, comprising:

(a) a base;

(b) a lens blank holder removably mounted to said base and having a central axis corresponding to the central axis of the formed lens block whereby the lens blank can be mounted on said holder with the optical axis of the lens blank aligned with said central axis;

(c) means on said base for aligning the lens blank on said holder with the central axis of the hardened lens block aligned with the optical axis of the lens blank;

(d) a substantially planar plate member having at least two projecting members spaced apart and aligned thereon such that said holder can be placed on said plate member with a line drawn through the mechanical center of the lens blank aligned with said projecting members; said plate member, said holder, and said lens blank defining an enclosed chamber into which the lens block material in a liquid state is introduced, said projecting members defining recesses in the hardened lens block along said line through the mechanical center of the lens blank;

(e) whereby the blocked lens blank has its optical center aligned with the central axis of the lens block and its mechanical center on a line drawn through said recesses formed on the lens block.

9. Apparatus in accordance with claim 8 wherein said lens blank holder comprises:

(a) an annular member having inside and outside diameters, said inside diameter defining the exterior dimension of said lens block; and (b) means including a clamp for securing said lens blank to said annular member.

10. Apparatus in accordance with claim 9 wherein said aligning means comprises:

(a) a retaining ring having an outside diameter substantially equivalent to said inside diameter of said annular member;

(b) a grid affixed within said retaining ring, said grid marked to indicate the central axis of said retaining ring; and (c) whereby said annular member is attached to said retaining ring and said lens blank is placed on said annular member with said optical center aligned with said central axis.

11. Apparatus for mounting a lens block to an optical lens blank having predetermined optical and mechanical centers, the lens block formed of material which is applied to the lens blank as a fluid and which hardens to form the block, the hardened lens block having a central axis, comprising:

(a) a base;

(b) an annular lens blank holder removably mounted to said base and having an inside and an outside diameter and a central axis corresponding to the central axis of the formed lens block, said inside diameter defining the outside diameter of the lens block, said annular holder having a surface on which the lens blank is placed;

(c) means on said base for aligning the lens blank on said annular holder with said central axis of said holder aligned with the optical axis of the blank;

(d) a plate member affixed to said base and having a plurality of aligned projecting members and an aperture disposed therein, said projecting members and said aperture spaced apart on said plate member whereby said annular holder may be placed on said plate with said projecting members and said aperture within said annular holder and with a line drawn through the mechanical center of the lens blank aligned with said projecting members; said annular holder, said plate member, and the lens blank defining a chamber into which the lens block material in a liquid state is introduced; and (e) means on said base for introducing the lens block material in a liquid state through said aperture into said chamber whereby a lens block is adhered to the lens blank about said optical center and has a plurality of recesses therein disposed along a line drawn through the mechanical center of the lens blank.

12. Apparatus in accordance with claim 11 wherein said plate comprises:

(a) a first end portion having a substantially planar surface;

(b) a second end portion;

(c) a continuous side wall interconnecting the said first and second end portions, said first and second end portions and said continuous side wall defining an enclosed chamber into which cold water is introduced to cool said liquid block material.

13. Apparatus in accordance with claim 12 wherein said projecting members extend outward from said first and said second end portions and wherein said projecting members are formed of a material permitting the passage of light therethrough.

14. Apparatus in accordance with claim 13 further comprising an illumination source disposed proximate said projecting members that extend outwardly from said second end portion, whereby said projecting members transmit light therethrough to facilitate the alignment of said annular holder on said substantially planar surface of said first end portion such that a line drawn through said mechanical center passes through said projecting members.

15. Apparatus in accordance with claim 14 wherein said annular member is hollow and wherein said apparatus further comprises means for introducing cold water into the hollow interior of said annular holder.

16. A method of mounting a lens block to an optical lens blank having predetermined optical and mechanical centers, said lens block formed of material which is applied to said lens blank in a fluid state and which hardens to form said lens block, said hardened lens block having a central axis, comprising the steps of:

(a) aligning said lens blank on a lens blank holder such that said optical axis of said lens blank will be aligned with the central axis of said hardened lens block;

(b) aligning said lens blank holder on a plate member having at least two projecting members such that a line drawn through the mechanical center of said lens blank is aligned with said projecting members; said holder, said plate member, and said lens blank defining an enclosed chamber;

(c) introducing lens block material in a liquid state into said chamber; and (d) permitting said lens block material to harden such that said hardened lens block has recesses therein formed by said projecting members along a line drawn through said mechanical center of said lens blank.

17. A method in accordance with claim 16 wherein the step of aligning said lens blank on a lens blank holder further comprises the steps of:

(a) placing said lens blank on an annular lens blank holder, said annular holder having an inside diameter which defines the exterior dimension of said hardened lens block and said holder having an annular enclosed chamber within said annular holder; and (b) placing said annular holder on a retaining ring having an outside diameter substantially equivalent to said inside diameter of said annular holder, said retaining ring having a grid therein on which is marked the center of said retaining ring;

(c) aligning said lens blank such that said optical center of said lens blank is placed over said marked center on said grid.

18. A method in accordance with claim 17 wherein said lens block material has a melting point lower than said lens blank and wherein said lens block material is introduced into said chamber in a molten state.

19. A method in accordance with claim 18 wherein the step of allowing said lens block material to harden comprises a step of cooling said lens block material in the molten state.

20. A method in accordance with claim 19 wherein said plate member is provided with an enclosed chamber and wherein the step of cooling said lens block material comprises the step of circulating cold water through said enclosed chamber in said plate member and said annular chamber in said annular holder.

* * * * *

UNITED STATES PATENT AND TRADEMARK OFFICE

CERTIFICATE OF CORRECTION

PATENT NO. : 4,136,727

DATED : January 30, 1979

INVENTOR(S) : Albert B. Vogt

It is certified that error appears in the above-identified patent and that said Letters Patent are hereby corrected as shown below:

Column 2, line 51, after the word "lapping" insert the words --and polishing steps--.

Column 3, line 28, the word "leens" should be changed to --lens--.

Column 8, line 10, the word "an" should be changed to --and--.

Signed and Sealed this

*Nineteenth* Day of *June 1979*

[SEAL]

*Attest:*

RUTH C. MASON
*Attesting Officer*

DONALD W. BANNER
*Commissioner of Patents and Trademarks*